US005124928A

United States Patent [19]

Aemmer

[11] Patent Number: 5,124,928

[45] Date of Patent: Jun. 23, 1992

[54] SYSTEM FOR MONITORING A PLURALITY OF TEXTILE MACHINE WORKSTATIONS

[75] Inventor: Peter F. Aemmer, Wettswil, Switzerland

[73] Assignee: Zellweger Uster AG, Uster, Switzerland

[21] Appl. No.: 426,450

[22] Filed: Oct. 25, 1989

[30] Foreign Application Priority Data

Oct. 25, 1988 [CH] Switzerland ..... 03969/88

[51] Int. Cl.[5] ..... G06F 15/46

[52] U.S. Cl. ..... 364/470; 73/160; 57/264; 364/138

[58] Field of Search ..... 364/470, 138, 139, 550, 364/551.01, 552, 554, 513; 28/185, 187; 73/159, 160; 57/81, 264, 265, 362

[56] References Cited

U.S. PATENT DOCUMENTS

| | | | |
|---|---|---|---|
| 4,430,720 | 2/1984 | Aemmer | 364/552 |
| 4,656,465 | 4/1987 | Erni et al. | 340/679 |
| 4,736,324 | 4/1988 | Sainen et al. | 364/470 |
| 4,774,673 | 9/1988 | Aemmer | 364/470 |
| 4,835,699 | 5/1989 | Mallard | 364/470 |
| 4,916,625 | 4/1990 | Davidson et al. | 364/470 X |

*Primary Examiner*—Joseph Ruggiero

*Attorney, Agent, or Firm*—Burns, Doane, Swecker & Mathis

[57] ABSTRACT

The system contains measurement elements (MK) associated with the workstations, and means (PC) for evaluating the signals supplied by the measurement elements (MK), characteristic parameters being obtained during the evaluation for the individual workstations and analyzed for significant deviations from the corresponding desired values. The desired values are formed from the behavior of a statistically comparable collective. At the beginning of each monitoring operation generalized start values are used for the individual desired values, which are converted during the course of the monitoring into more accurate, absolute values. These are updated continuously and form the core data for an automatic inference process. Consequently, the method of functioning of the system, which can be employed in particular in winding rooms for monitoring automatic spoolers, is automatic and objective, and the evaluation of the measurement results becomes independent of the interpretation of the operating personnel.

20 Claims, 4 Drawing Sheets

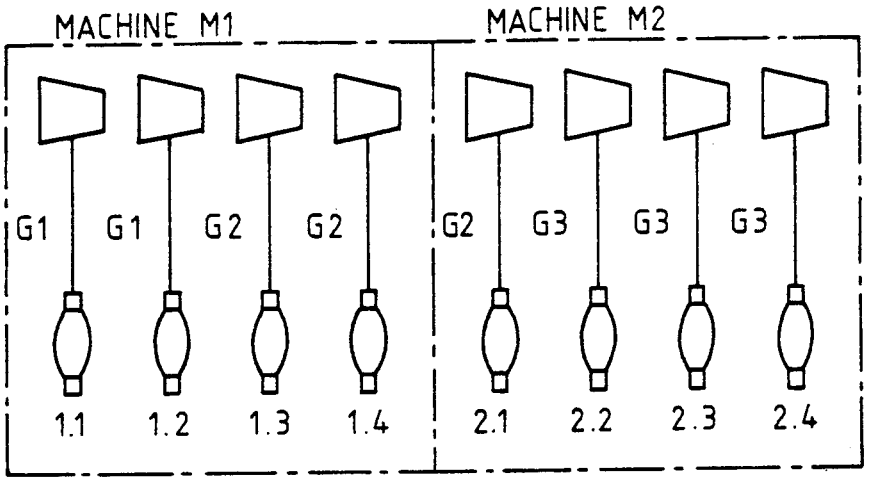
FIG. 3a
| x | Mach(x) | Yarn(x) |
|---|---|---|
| 1.1 | 1 | G1 |
| 1.2 | 1 | G1 |
| 1.3 | 1 | G2 |
| 1.4 | 1 | G2 |
| 2.1 | 2 | G2 |
| 2.2 | 2 | G3 |
| 2.3 | 2 | G3 |
| 2.4 | 2 | G3 |
FIG. 3b
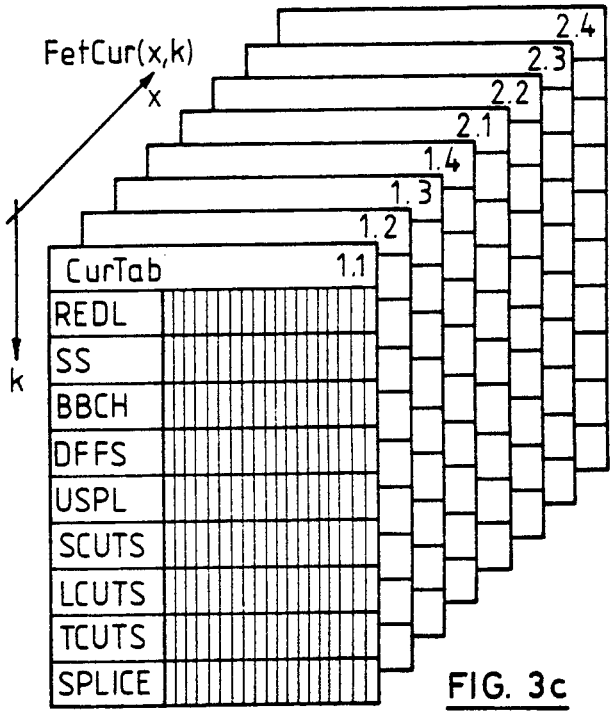
FIG. 3c
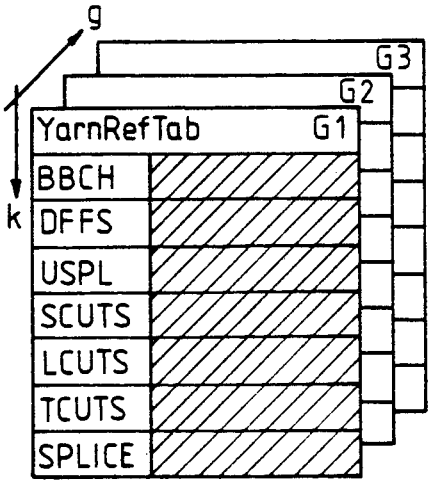
FIG. 3d
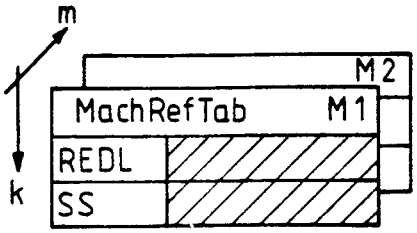

SYSTEM FOR MONITORING A PLURALITY OF TEXTILE MACHINE WORKSTATIONS

BACKGROUND OF THE INVENTION

The invention relates to a system for monitoring a plurality of textile machine workstations, having measurement elements associated with the workstations and having means for evaluating the signals supplied by the measurement elements, characteristic parameters being obtained during the evaluation for the individual workstations and analyzed for significant deviations from corresponding desired values.

Systems of this kind are used, for example, in winding rooms for monitoring automatic spoolers which have a plurality of individual spindles and which are equipped with so-called yarn cleaning systems. The parameters obtained from the evaluation of the signals of the measurement elements are analyzed more or less in isolation for each individual spooling station, so that although fault situations which occur are detected and can therefore be rectified, no automatic cross-comparisons between the individual fault situations are possible. This means that it is relatively difficult to weight the individual fault situations and bring them into a mutual relationship. Without a networking of this kind, however, the monitoring system consists of only a plurality of isolated monitors for individual spooling stations.

Although the data processed by the analysis of the stated parameters are available on a screen and/or printer as lists or graphics respectively, their interpretation depends on the judgement and the skill of the respective operator, so that it is not ensured that correct inferences are actually made from the data obtained.

The invention is intended, then, to make it possible for specific inferences to be made by the system itself, in that the latter applies defined rules. This is intended to ensure, on the one hand, that the same inferences are always made from the same data, and, on the other hand, that even complex fault situations can be identified clearly and reliably. In other words, the method of operation of the monitoring system in accordance with the present invention is to be automatic and objective.

SUMMARY OF THE INVENTION

This object is achieved according to the invention in that:

a) the desired values are formed by the behavior of a statistically comparable collective;

b) at the beginning of each monitoring operation generalized start values are used for the individual desired values; and c) the generalized start values are converted during the course of the monitoring into more accurate values.

In accordance with a preferred further development of the system according to the invention, the desired values are updated continuously by processing the data obtained from all of the workstations in the form of averages of individual events and averages of the collective events, and form the core data for an automatic inference process, said desired values having safety clearances added thereto which are known from experience and which can be entered into the system. The safety clearances define warning, alarm or shutdown limits for events observed at the individual work stations.

Consequently, in the system according to the invention specific inferences are made by the system itself, in that it applies a set of rules. That is, the continuous updating of the averages of the individual events and averages of the collective, and the constant comparison thereof with one another make the system a knowledge-based expert system with production rules. In the course of the inference process, a dynamic knowledge base is built up, the contents of which are formed, for example, be corrected averages of the collective events after a lengthy period of operation or by inferences from rules.

The monitoring system according to the invention therefore analyzes the signals supplied by the measurement elements, the signals being representative of events indicative of operation of the spooling stations, in order to detect significant deviations from corresponding desired values. The desired values are, on the one hand, input data stemming from the user, and on the other hand experience data formed by the system itself, the desired values serving as a criterion for indicating alarm states.

A further development of the system according to the invention is characterized in that the generalized start values are converted into more accurate values on the basis of an adaptive learning technique.

BRIEF DESCRIPTION OF THE DRAWINGS

The invention will be explained below in more detail with reference to an exemplary embodiment and the drawings, wherein like elements are referred to by like designations, and wherein:

FIGS. 3*a*, 3*b*, 3*c* and 3*d* show an example of the data stores of the ACS system of FIG. 1, and FIGS. 4 and 5 show flowcharts to explain the operation of the exemplary embodiment.

DETAILED DESCRIPTION OF THE PREFERRED EMBODIMENTS

Figure 1:
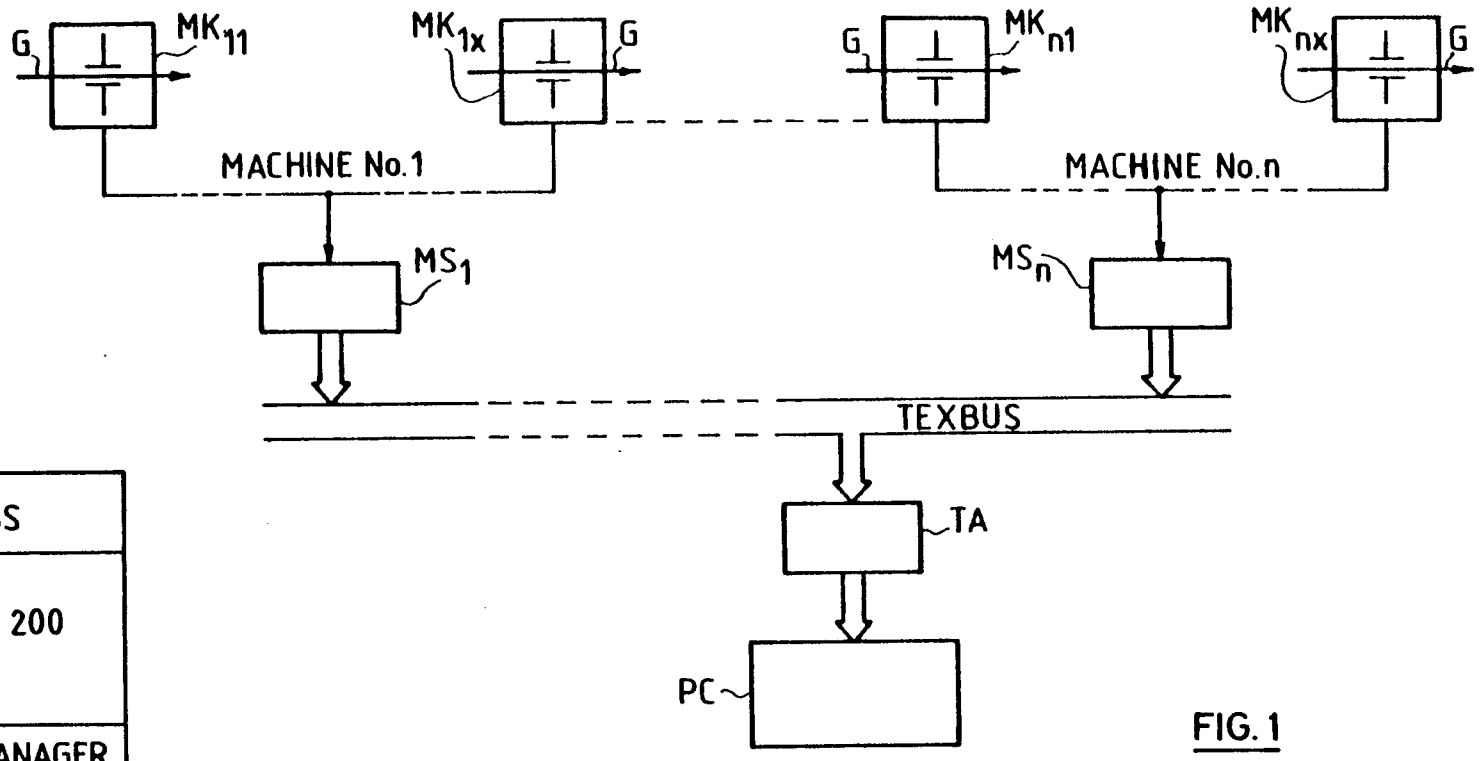
FIG. 1 shows a diagrammatic representation of the individual function stages of an ACS monitoring system according to the invention.

The diagram of FIG. 1 shows the structure of a monitoring system according to the invention for a plurality of textile machine workstations, for example spooling machines. Each of n spooling machines shown in FIG. 1 has a number x of spooling stations, each of which is equipped with a measurement head MK for measuring the cross-section of a running yarn G. Each measurement head MK is a part of an electronic yarn cleaner and serves to record specific yarn faults, in particular short thick places (so-called S channel), long thick places (so-called L channel) and thin places (so-called T channel). The designations S channel, L channel and T channel are known from the yarn cleaning systems of the make USTER of Zellweger Uster AG.

The signals of all measurement heads MK11 to MK1x, MKn1 to MKnx for each spooling machine are, in each case, supplied to a machine station MS1 or MSn, as is known, for example, from data systems of the make USTER CONEDATA 200 (hereinafter referred to as CODA 200). The machine stations MS provide the user with information on the operating behavior of the spooling machines and the yarn quality, specifically for each individual machine spooling station, or position. Since the machine stations are also equipped with their own input keyboard and LCD display, data of the connected spooling machine can be directly entered, selected and displayed.

Figure 2:
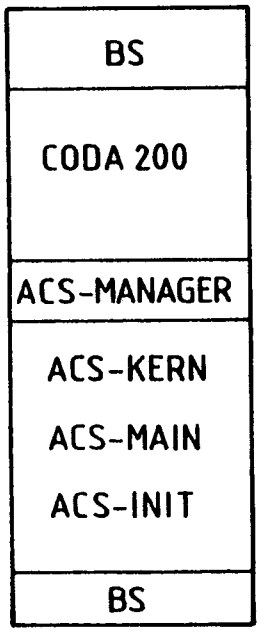
FIG. 2 shows a diagram of the division of the system memory of the computer for the system of FIG. 1.

The data of all machine stations MS are forwarded via a known bus, such as a so-called TEXBUS, to a TEXBUS adapter TA, and from there to a Personal Computer PC, the hardware design of which corresponds essentially to that of the stored-program computer described in EP-A-001 640 (see, for example, FIGS. 2 and 3) the disclosure of which is hereby incorporated by reference in its entirety, and which has in particular a system memory, the division of which is illustrated diagrammatically in FIG. 2.

FIG. 2 shows from the top downwards the following software configuration within the Personal Computer PC: memory space for an operating system designated BS, memory space for the aforementioned data system CODA 200, memory space for a master alarm conditions scanner program designated ACS-Manager, then a common memory space for three alarm conditions scanner programs ACS-Kern, ACS-Main and ACS-Init, and finally once again memory space for the operating system BS. With respect to the common memory space for the three programs mentioned, it should also be mentioned that these three programs are never simultaneously active, so that all can use the same memory space, as a result of which memory spaced is saved.

The monitoring system according to the invention thus consists essentially of the hardware components illustrated in FIG. 1 and of the programs evident from FIG. 2, the cooperation of which opens up new possibilities for recording fault situations in winding rooms or generally in textile plants.

It is very important for the operation of a winding room today to have objective information on the operating behavior of the spooling machines and the yarn quality available, because it is only on the basis of this information that the necessary compromises can be found in the selection of expedient settings on spooling machines and yarn cleaning systems. These compromises are necessary to be able to optionally satisfy the sometimes contradictory requirements, such as the production of cross-wound bobbins with good running characteristics and a high degree of freedom from defects while having the lowest possible number of knots, achieving high production efficiency, that is to say high performance, and reliable recording of all disturbing yarn defects.

Data must therefore be available, with the aid of which optimum operating conditions can be found in order to create the prerequisites for a high degree of economic efficiency in the spooling process. An essential prerequisite for the finding of optimum operating conditions is the exact recording and identification of fault situations.

In known systems using the data system CODA, the data processed was available on a screen and/or printer as lists or graphics respectively, and had to be interpreted by the user responsible. With the proposed system in accordance with the present invention, specific inferences are now made by the system itself, in that the latter performs specific process steps. The events occurring at the individual spindles are continuously statistically evaluated and, as a result of the processing of the data set of all active spindles, updated averages both of the events associated with individual spindles and events of the collective spindles are available as comparison values which form the core data of an automatic inference process. Safety clearances known from experience such as, for example, a multiple of the standard deviation as a statistical measure and/or a percentage clearance value as a tolerance measure, are entered by the user and define warning, alarm or stop limits with respect to the events observed at the individual spindle.

The averages of the individual events and of the collective are updated continuously by the system and constantly compared to each other. There is therefore a knowledge base and an automatic inference process available to the system. In the course of the inference process, a dynamic knowledge base is built up, the contents of which can be formed, for example, by corrected averages of the collective after a long period of operation and/or by inferences from rules.

The abbreviation ACS used in FIG. 2 stands for Alarm Conditions Scanner; this designation will be explained later. The implementation of the ACS, that is to say the interaction of the four programs ACS-Manager, ACS-Kern, ACS-Init and ACS-Main will now be explained.

ACS-Manager forms the master program for all programs in connection with the ACS system, and all programs which work with the ACS communicate only via the ACS Manager. ACS-Manager is responsible for the following eight main tasks: a sub-program designated ACS-Damon, management of the internal constants, winding room configuration including shift and batch changes and management of various tables (FIG. 3).

Figure 4:
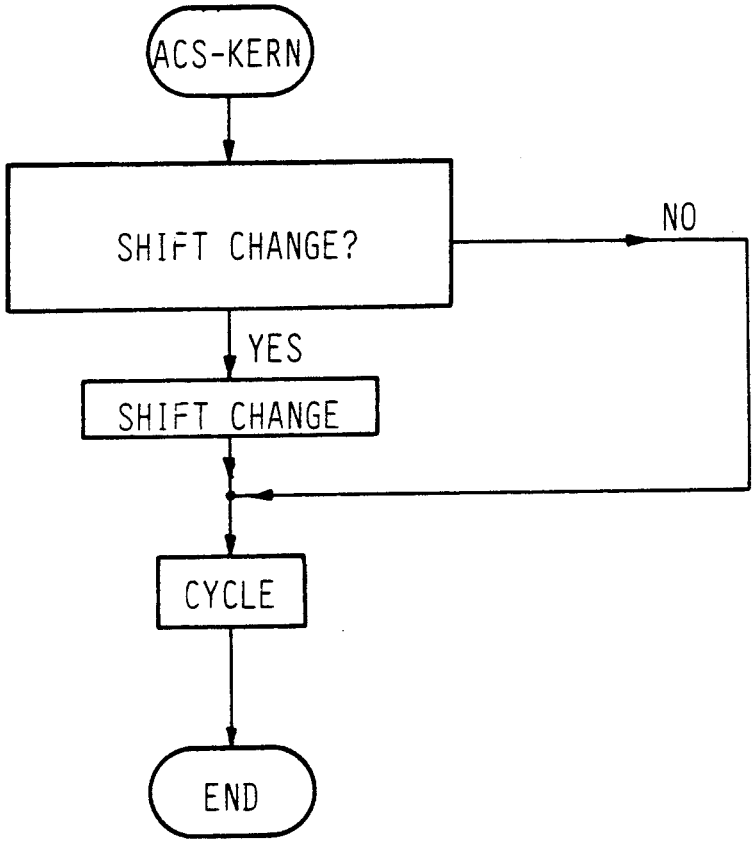
Figure 5:
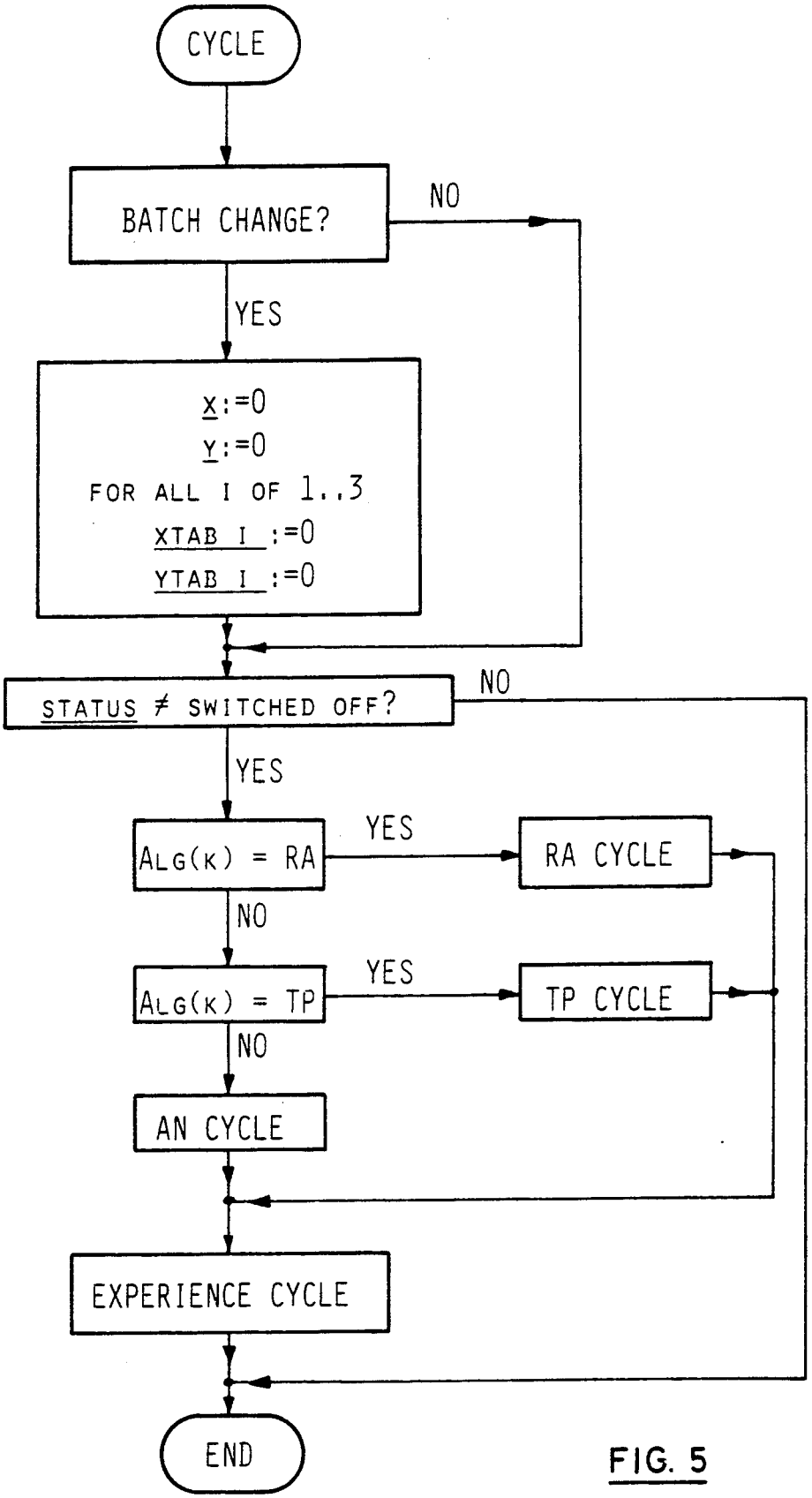

ACS-Damon is a sub-function of ACS-Manager. It is activated periodically by CODA 200 and establishes whether a time Delta t has elapsed since the last call of the program ACS-Kern. If yes, ACS-Kern is called up again. The main routine of ACS-Kern is illustrated in the flowchart of FIG. 4. The sub-routine "shift change" shown in this flowchart causes all xold and yold in current tables (which will be discussed with respect to FIG. 3*c*) to be reset to zero. The subroutine "cycle", likewise shown in the FIG. 4 flowchart, is illustrated in the flowchart of FIG. 5. This cycle is executed once for all spooling stations and channels. The term "Alg(k)" is used in FIG. 5 in each case to designate the cycle associated with the current channel; that is, each channel of each spooling station is associated with one of the subroutines "AN cycle", "RA cycle", "TP cycle" and "experience cycle", which will be more fully described with respect to the code tables 4 to 7. In the flowcharts and in the code tables, the table values always denote those values which are valid for the respective spooling station and the respective channel; the table values underlined in the flowchart of FIG. 5 are values of a current table (to be discussed with respect to FIG. 3*c*).

The ACS-Kern program only includes the steps for executing the aforementioned cycles and the alarm processing. It has no statistical data and receives all its data material from the manager. The program ACS-Init merely loads the tables stored in files into ACS-Manager and is used to start the system.

ACS-Main is the program which the user can call up from CODA 200 in order to alter parameters, view accumulated alarms or obtain on-line information.

In operation, the ACS-Manager program is initially loaded. In order for the ACS Manager to receive the necessary parameters without the user having to type them in, ACS-Init supplies the manager with start parameters. ACS-Init, in turn, obtains these parameters from a prestored file. CODA 200 is then started; this is the main program in the following. This means in other words that other programs are only started if initiated by CODA 200, and that CODA 200 receives control again after these programs have been executed.

CODA 200 now supplies ACS-Manager sporadically with the new spooling room data and periodically calls up the ACS-Damon program (function of ACS-Manager) which tests whether the time (Delta t) for updating and executing an alarm cycle has arrived (updating and alarm cycle are both parts of ACS-Kern). If yes, then ACS-Kern is started by ACS-Manager and the necessary actions are executed.

The programs ACS-Init, ACS Manager and ACS-Kern run without providing display information to the user, with the exception of any alarm messages generated by ACS-Kern. The user can, however, call up ACS-Main from the CODA 200 data system if the user wishes to, for example, alter parameters, view accumulated alarms or obtain on-line information.

ACS is a system with which specific values are observed as a function of other values and alarm states are determined as a result of threshold values being exceeded, these threshold values being generated either from inputs by the user or from automatically formed experience values (i.e., values input by the user which, for example, have been modified on the basis of system operation). A type of monitoring used in accordance with the present invention involves the observation of a value as a function of another value, and is termed a "channel" in the following discussion. The following channels are preferably used in a preferred embodiment of the invention, it being of course possible for other channels to be added or existing ones to be omitted (in the following channels, "splice" designates a connecting of thread ends, regardless of the type of connection, that is to say knotting or splicing):

SPLICE = number of splices since the last core change
REDL = number of red lights per time unit
SS = standstill time per splice
BBCH = cone change per spooled yarn length
DFFS = cop change per spooled yarn length
USPL = splice attempts per successful splice
SCUTS = number of S cuts per spooled yarn length
LCUTS = number of L cuts per spooled yarn length
TCUTS = number of T cuts per spooled yarn length For each of these channels three alarm stages are defined, which allow various statements to be displayed to the user depending on the respective criterion. A total of three different criteria are used, each channel being examined with respect to exactly one of these three criteria. The three criteria are: AN = number, RA = running average and TP = three-point.

In order for alarm thresholds to be formed from experience values in accordance with the present invention, a representative reference basis must be available for each spooling station and for each channel. This reference basis can be formed for each particular spooling station by using the same reference basis for all spooling stations of the same machine and by using the same reference basis for all spooling stations with the same yarn identification, that is to say with the same yarn batch. In practical execution, a separate reference basis exists for each machine-dependent channel for each machine, and for each yarn-dependent channel for each yarn batch. The alarm thresholds are values which must not be exceeded. For specific channels there are in addition to these maxima also minima; these are thresholds which the value must not fall below. The ACS is activated periodically and during its activity it updates all channels at all the spooling stations and determines any alarm states. An updating of this kind is called scan cycle.

TABLE 1

| | Classification of channels | | | | |
|---|---|---|---|---|---|
| Channel | Observed variable | Independent variable | C | Ref. basis | Min. |
| REDL | Red Lights | Time | RA | Mach. | No |
| SS | standstill time | Splice | RA | Mach. | No |
| BBCH | Cone change | Sp. Length | RA | Yarn | No |
| DFFS | Cop change | Sp. Length | RA | Yarn | Yes |
| USPL | Splice attempts | Successful splice | TP | Yarn | No |
| SCUTS | S cuts | Sp. length | TP | Yarn | Yes |
| LCUTS | L cuts | Sp. length | TP | Yarn | Yes |
| TCUTS | T cuts | Sp. length | TP | Yarn | Yes |
| SPLICE | Splices | — | AN | Yarn | — |

FIG. 3 outlines the data stores of the ACS system in accordance with a specific example: FIG. 3*a* shows two spooling machines M1 and M2 each with four spooling stations 1.1 to 1.4 and 2.1 to 2.4 respectively, at which three different yarn batches G1 to G3 are spooled. FIG. 3*b* shows the corresponding assignments between spooling stations x, machines m(x) and yarn batches G(K). FIG. 3*c* shows the current tables, as they are obtained during the monitoring at the individual spooling stations x for the individual channels k, and FIG. 3*d* shows the reference tables used with the reference basis machine for the two channels REDL and SS and the two spooling machines M1 and M2, and with the reference basis yarn for the three yarn batches G1 to G3 and the remaining 7 channels.

In accordance with FIG. 3*c*, a table with the current values exists for each spooling station. The FIG. 3*c* table includes, for each channel, the following information:

| | | |
|---|---|---|
| status | : | channel switched on at this position? yes/no |
| x | : | independent value (since last reset) |
| y | : | dependent value (since last reset) |
| xtab (1 . . . 3) | : | table with the x values of the individual alarm stages |
| ytab (1 . . . 3) | : | table with the y values of the individual alarm stages |

In addition there are also auxiliary values for the updating:

TABLE 2

| | | current TYPE table |
|---|---|---|
| xold | : | value of independent value at time To |
| yold | : | value of dependent value at time To |

As already mentioned, an individual reference basis exists for each machine and for each yarn batch. For each reference basis there exists for each associated channel in the tables shown in FIG. 3*d*, the following information:

| | | |
|---|---|---|
| Learning | : | automatic learning switched on? |
| DatFix | : | fix for the updating |
| ExpFix | : | fix for the formation of the experience value |

-continued

| | | |
|---|---|---|
| Alarm | | |
| FixTab (1 . . . 3) | : | table with the fixed values for alarm stages |
| Sigma | : | sigma factor when forming the threshold values |
| Margin | : | margin in percent for threshold values. |

The above data must be entered by the user.

TABLE 3

| reference TYPE table | | |
|---|---|---|
| MinTab (1 . . . 3) | : | table with lower threshold values (if necessary) |
| MaxTab (1 . . . 3) | : | table with upper threshold values |
| xep | : | x value for formation of experience value |
| yexp | : | y value for formation of experience value |
| exp | : | experience value |

The data MinTab and MaxTab can be entered by the user or formed by the ACS. The values xexp, yexp and exp are formed by the ACS system.

In order that the various cycles receive the correct table values in order to function, the mapping functions "cur": (table of current type) and "ref": (table of reference type) must exist. (The symbol used in the following ":=" represents an assignment: "a:=b" means: a assumes the value of b. The value of b remains unchanged.)

A first mapping function cur:=FetCurrent (x,k) will now be discussed. FetCurrent assigns the table CurTab the current values of the spooling station x for each channel k. This function can be realized simply, since the table of all values can be implemented as a two-dimensional matrix with the dimensions spooling station and channel.

A second mapping function ref:=FetReierence (x,k) will now be discussed. FetReference assigns the FIG. 3*d* reference tables the reference values which are valid for the spooling station x and the channel k. This function is more complicated than FetCurrent. The tables MachRefTab and YarnRefTab serve as sources. MachRefTab is a two-dimensional table over all machines and all channels belonging to each machine; YarnRefTab is a two-dimensional table for all yarn batches and all channels belonging to the yarn batch.

The term "fix" (DatFix, ExpFix) was used in the description of the form of the table of the reference type (FIG. 3*d*). A fix is a mark for the independent variable x. If x exceeds a specific fix a corresponding action is triggered. DatFix and ExpFix are there to save computing time, so that complex calculations which do not change substantially need not be executed for each scan cycle. The alarm fixes serve for grading the alarms.

When forming the experience values, a weighting of the past with respect to the present is necessary, and is realized with the aid of a past factor. For each channel a past factor is defined which is valid for the whole winding room.

In the column C of table 1 the criteria RA, TP and AN are stated, with reference to which the individual channels are examined. The cycles which form these criteria will now be described below, specifically with pseudocodes, which are very similar to the programming language Modula-2. With reference to the symbols employed in the pseudocodes, the following comments should first be made: the symbol ":=" (assignment) was already explained. Brackets indicate indices of tables, when their contents are underlined; for example, "a(i)" designates the ith value of the table a. Text between "(*" and "*)" is commentary, and indentations are intended to clarify the validity ranges of control structures such as IF x THEN y OTHERWISE z END IF. T0 designates the time of the cycle preceding the current scan cycle and T1 designates the time of the current scan cycle.

The cycle AN as shown in the code table 4 does not observe a variable as a function of another, but sums only the frequency of an event since the last occurrence of another event. This means in practice that AN is only used on one channel of the exemplary embodiment (to be precise on the channel SPLICE) and counts the number of splices per cone, that is to say since the last cone change. An alarm is triggered if the splices exceed a specific number.

CODE TABLE 4

```
PSEUDOCODE for the AN Cycle
REPEAT FOR all spooling stations
    X : = spooling station number (position)
    IF channel SPLICE at position switched on THEN
                (****updating****)
        yold : yarn batch which was spooled at spooling
station x at time T0
        ynew : yarn batch which is spooled at spooling
station X at time T1
        sold : = number of splices at spooling station x at
time T0
        snew : = number of splices at spooling station x at
time T1
        cold : = number of cone changes at spooling station
x at time T0
        cnew : = number of cone changes at spooling station x
at time T1
        If yold is unequal to ynew THEN
        (* A yarn batch change has taken place between      *)
        (* T0 and T1, therefore resetting of previous
        (* splice state and setting of yold again           *)
        *) splice_number : = 0                              *)
        yold                : = ynew
    END IF
    IF cnew is greater than cold THEN
        (* a cone change has taken place between T0 and T1,  *)
        (* therefore the previous splice state is reset      *)
        splice_number : = 0
OTHERWISE
        splice-number : = splice_number + snew − sold
END IF
        (**** determine alarm state ****)
        (* determining a maximum from reference table *)
        max_splices : = maximum number of splices on yarn
        batch ynew
        IF splice-number is greater than max-splices THEN
        trigger splice alarm
        END IF
END IF
END REPEAT
```

In contrast to AN, the cycles RA and TP are used for several different channels of each spooling station. Here the pseudocode is not stated for each channel, rather the data structures set forth above in tables 2 and 3 are used.

The running average cycle (ALG (K)=RA) is shown in Code Table 5 and has three value pairs with x and y values, the x values of which are separated in each case by DatFix. The most current value pair is x1/y1, the "oldest" is x3/y3. An xy value pair is updated until x exceeds the value DatFix. This value pair is then normalized to the interval DatFix and made the value pair x1/y1. The old value pairs x1/y1 and x2/y2 are shifted backwards to become x2/y2 and x3/y3, respectively; the previous x3/y3 is lost. After an updating it is tested whether an alarm has occurred, whereby the alarm stages are defined.

Alarm stage 1 is an immediate exceeding of a limit value (y1 is greater than max1 or less than min1), alarm stage 2 represents the running average ((y1+y2+y3 greater than max2) or (y1+y2+y3 less than min 2)), and alarm stage 3 establishes whether a clearly incorrect trend predominates ((y1−y3 greater than max3) or (y3−y1 less than min3)).

The threshold values of stages 1 and 3 must be supplied by the user, and the threshold values of alarm stage 2 can be learnt from experience.

CODE TABLE 5

```
PSEUDOCODE RA cycle
REPEAT FOR all spooling stations
    n := spooling station number
    k := channel monitored with RA
    (******* updating *******)
    IF status = switched on THEN
        ref := FetReference (n, k)
        (* fetches reference basis table for n and k *)
        IF RefTyp (k) = yarn THEN
            yold := yarn batch which was spooled at n at T0
            ynew := yarn batch which is spooled at n at T1
            IF yold is unequal to ynew THEN
                (* a yarn batch change has taken place
                between                                  *)
                (* T0 and T1, therefore resetting of
                previous                                 *)
                (* splice state and setting yold again   *)
                    x          := 0
                    y          := 0
                    ytab (1)   := 0
                    ytab (2)   := 0
                    ytab (3)   := 0
                    yold       := ynew
            END IF
        END IF
    xcur:= current x value at spooling station n since
    start of shift
    ycur:= current y value at spooling station n since
    start of shift
    x   := x + xcur − xold
    y   := y + ycur − yold
    xold:= xcur
    yold:= ycur
    AS LONG AS x is greater than DatFix REPEAT the
following steps
                    (* shift and form normalized new value *)
                    ytab(3) := ytab (2)
                    ytab(2) := ytab (1)
                    ytab(1) := y/x · DatFix
                    (* updating of current values *)
                    x := x − DatFix
                    y := y − ytab (1)
                    (* updating of reference basis *)
                    xref := xref + DatFix
                    yref := yref + ytab(1)
                    (******* determine alarm states *******)
                    IF ytab(1) is greater than MaxTab(1) OR
ytab(1) is less than MinTab(2) THEN
                            Alarm (channel k, stage 1)
                    END IF
                    sum := ytab(1)+ytab(2)+ytab(3)
                    IF sum is greater than MaxTab(2)
                    OR sum is
                    less than MinTab(2) THEN
                            Alarm (channel k, stage 2)
                    END IF
                    diff := ytab(1) − ytab (3)
                    IF diff is greater than MaxTab(3) OR -diff is
                    less than MinTab(3)
                    THEN
                            Alarm (channel k, stage 3)
                END IF
                (* minima only for channels where necessary
                according to Table 1 *)
        END AS LONG AS
    END IF
```

CODE TABLE 5-continued

```
END REPEAT
```

The three point cycle (i.e., ALG (K)=TP) as shown in the Code Table 6 has, in contrast to the cycle RA, three identical stages, the number of stages having no superordinate significance, but arises from the symmetry to RA, which is defined as having three alarm stages. The three stages of TP differ only on one point, namely in the fix value of x.

An xy pair is updated until x has exceeded the AlarmFixTab value of its stage. When the x value of an alarm stage has exceeded its AlarmFixTab value, then the xy pair is normalized to the latter and compared with the threshold values. If the value is exceeded or not reached then an alarm is triggered. After comparison of the normalized xy pair, the latter is multiplied with the past factor, a distinction not being drawn between whether an alarm stage was determined or not. The threshold values of each alarm stage can be learnt from experience.

CODE TABLE 6

```
PSEUDOCODE TP cycle
REPEAT FOR all spooling stations
    n := spooling station number
    k := channel monitored with TP
    (******* updating *******)
    IF status = switched on THEN
        ref := FetReference (n,k)
        IF RefType (k) = yarn THEN
            yold := yarn batch which was spooled at station
            number n at T0
            ynew := yarn batch which is spooled at station
            number n at T1
            IF yold is unequal to ynew THEN
                (* a yarn batch change has taken place
                between *)
                (* T0 and T1, therefore resetting of current   *)
                (* values                                      *)
                x := 0
                y := 0
                        REPEAT FOR alarm stages 1 . . . 3
                        i          := number of alarm stages
                        xtab(i)    := 0
                        ytab(i)    := 0
                        END REPEAT
                        yold := ynew
        END IF
END IF
xcur:= current x value at spooling station n since
start of shift
ycur:= current y value at spooling station n since
start of shift
x := x + xcur − xold
y := y + ycur − yold
xold:= xcur
yold:= ycur
IF x is greater than DatFix THEN
        (* this barrier is to save computing time *)
        REPEAT FOR alarm stage 1 . . . 3
                i          := number of alarm stage
                xtab(i)    := xtab(i) + x
                ytab(i)    := ytab(i) + y
        END REPEAT
        (* updating of reference basis *)
        xref := xref + x
        yref := yref + y
        (* zeroing of recording*)
        x   := 0
        y   := 0
        (******* determine alarm states *******)
        REPEAT FOR alarm stages 1 . . . 3
                i := number of alarm stage
                (* normalize for alarm comparison *)
                w := ytab(i)/xtab(i). AlarmFixTab (i)
                IF w is greater than MaxTab(i) OR w is less
                than MinTab(i) then
```

CODE TABLE 6-continued

```
                alarm (channel k, stage i)
            END IF
            (* past factor *)
                pfac        := past factor of channel k
                xtab(i)     := pfac · xtab(i)
                ytab(i)     := pfac · ytab(i)
            END REPEAT
        END IF
    END IF
END REPEAT
```

An essential feature of the ACS system is the self-learning mechanism, that is to say the possibility of forming threshold values from experience values. A representative basic set of reference values for statistical interpretation is available in the form of the reference bases described with respect to FIG. 3*d*. There is for each channel, analogous to the normal updating, an x value and a y value which have the same meaning as the variables in Table 1. Instead of gathering these values per spooling station, they are now summed from all the spooling stations which are associated with this reference basis (see cycle, RA and TP).

In order that the accuracy of the statistical interpretation is ensured as far as possible, after each scan cycle every channel of every reference basis is tested to see whether its x value has exceeded the fix value of the recording. If yes, then a new experience value and a new threshold value are formed, the new experience value being composed of a weighting of the new values and of the old experience value.

A prerequisite for the formation of a threshold value is that the occurrence of an event obeys the Poisson distribution. Subject to the limit value of de Moivre-Laplace, this is replaced by a normal distribution. If, in the FIG. 3*d* reference tables, "Sigma" denotes the confidence interval in multiples of the standard deviation, "Margin" denotes the margin in percentages divided by 100 (i.e., tolerance) and "exp" denotes an experience value determined through observation and normalized and weighted according to desired requirements, then the following formulation is obtained for determining the deviation "dev" of a threshold value from the average:

dev :=Sigma square root of exp+Margin exp

Min :=exp−dev

Max :=exp+dev

The flowchart of the experience cycle is illustrated in the Code Table 7, pfac denoting the past factor of the current channel. This cycle is used to calculate for the channel k the minimum and maximum in the FIG. 3*d* reference tables.

CODE TABLE 7

```
PSEUDOCODE experience cycle
IF xref is greater than ExpFix THEN
            (*statistical basic set sufficiently large *)
            value := yref/xref · ExpFix
(* linear extrapolation of yref yields value/ExpFix =*)
(* yref/xref, i.e., normalization of yref accoring      *)
(* to ExpFix                                            *)
pfac := past factor of channel k
xref := pfac · xref
yref := pfac · yref
(*weighting of past *)
IF exp = 0 THEN
            (* initialized experience value formation *)
            exp := value
OTHERWISE
            exp := pfac · exp + (1 -pfac) · value
            (* weighting of old/new experience value *)
```

CODE TABLE 7-continued

```
END IF
IF leaning switched on THEN
            IF Alg(k) = RA THEN
                (* running average calculated only for
                alarm stage 2 *)
                (* threshold values are determined
                from experience values                  *)
                (* the threshold values of stage 2 must
                be normalized to three times DatFix     *)
            Average : = 3 · DatFix/ExpFix · exp
            (* Average is the normalized experience
            value *)
            dev := SQUARE ROOT (Average) ·
            Sigma + Average · Margin
            MinTab(2) := Average − dev
            MaxTab(2) := Average + dev
OTHERWISE
            (* three-point calculated for all alarm
            stages *)
            (* threshold values from experience values,
            the*)
            (* threshold values of the alarm stage i
            must be                                     *)
            (* normalized to AlarmFixTab(i)             *)
            REPEAT FOR alarm stage 1, 2, 3
            i           := alarm stage
            average     := AlarmFixTab(i)/ExpFix · exp
            dev         :=ROOT (Average) · Sigma +
                        Average · Margin
            MinTab(i) := Average − dev
            MaxTab(i) := Average + dev
        END REPEAT
    END IF
  END IF
END IF
```

The reason that the values of alarm stage 2 for the RA cycle must be normalized to three times DatFix is that in this cycle only the threshold values of alarm stage 2 can be learnt from experience. All three y values are summed analogously for the test.

It will be appreciated by those of ordinary skill in the art that the present invention can be embodied in other specific forms without departing from the spirit or essential characteristics thereof. The presently disclosed embodiment is therefore considered in all respects to be illustrative and not restrictive. The scope of the invention is indicated by the appended claims rather than the foregoing description, and all changes that come within the meaning and range of equivalents thereof are intended to be embraced therein.

What is claimed is:

1. Process for monitoring a plurality of textile machine workstations, having measurement elements associated with the workstations and having means for evaluating the signals supplied by the measurement elements, characteristic parameters being obtained during the elevation for the individual workstations and analyzed for significant deviations from corresponding desired values, comprising the steps of:

a) forming individual desired values based on operation of a statistically comparable set of data from said plurality of textile machine workstations;

b) using generalized start values at the beginning of each monitoring for the individual desired values; and c) converting the generalized start values during the course of the monitoring into updated individual desired values.

2. Process according to claim 1, further comprising the step of continuously updating the desired values by processing the data of all workstations as averages of individual events and as averages of collective events, and forming core data for an automatic inference process. said desired values being supplemented by safety clearances which are known from experience and which can be entered into the system and which define warning, alarm and shutdown limits for the events observed at the individual workstations.

3. Process according to claim 2, further comprising the step of converting the generalized start values into more accurate values using an adaptive learning technique.

4. Process according to claim 3, further comprising a step of monitoring at least one parameter in a channel as a function of another, said monitoring of said at least one parameter being performed with respect to a predetermined criterion, and defining plural limit values for said channel.

5. Process according to claim 4, wherein, for defining the desired values for the individual workstations, a separate reference basis is provided for each machine-dependent channel per machine and for each yarn-dependent channel per yarn batch.

6. Process according to claim 5, wherein one table with current measurement values for each channel and one table with values of a reference basis for the corresponding channels are associated with each workstation.

7. Process according to claim 6, wherein desired values are defined by defining a past factor, and by using the past factor to weight past measured values.

8. Process according to one of claim 7, wherein three alarm stages indicate a sudden great deviation, clear deviation over a longer period, and exceeding of a threshold by the gradient, respectively.

9. Process according to claim 8, wherein each channel is associated with a variable to be observed and an independent variable, the independent variable being associated with a mark which, when exceeded by the variable, triggers an action, and wherein after each updating of all channels it is examined at all workstations whether an independent variable of a channel of a reference basis has exceeded its mark.

10. Process according to claim 9, wherein each time the said mark is exceeded by an independent variable the formation of a new desired value is triggered, the new desired value being formed by weighting new measured values and an old desired value.

11. Method for monitoring yarn clearing at a plurality of individual textile workstations comprising the steps of:

measuring a first parameter representing cross-sectional dimensions of yarn being processed at each of a plurality of textile processing stations;

establishing desired limit values for said cross-sectional dimensions, said limit values being set independently for each of said plurality of textile processing stations; and continuously updating each of said limit values during processing of said yarn at each of said textile processing stations using data from said plurality of textile processing stations.

12. Processing according to claim 11, wherein said step of continuously updating further comprises the steps of:

averaging data from said plurality of textile processing stations;

compiling data for an automatic inference process; and supplementing the desired limit value at each textile processing station with predetermined safety clearance values representing warning, alarm and shutdown limits associated with that textile processing station.

13. Processing according to claim 11, wherein said step of continuously updating is performed using adaptive learning.

14. Method according to claim 11, wherein said step of measuring further includes the steps of:

monitoring a second parameter as a function of a third parameter at a given textile processing station, said monitoring being performed with respect to a predetermined criterion; and defining plural limit values for said second parameter.

15. Process according to claim 14, wherein said step of establishing desired limit values further includes the step of:

providing a reference value for each of a plurality of machine-dependent parameters per machine and providing a reference value for each of a plurality of yarn-dependent parameters per yarn batch.

16. Process according to claim 15, further comprising a step of:

correlating each textile processing station with current measurement values and with corresponding reference values for each parameter.

17. Process according to claim 11, wherein said step of establishing desired limit values further includes the step of:

defining a past factor and using said past factor to weight past measured values.

18. Process according to claim 17, wherein said step of establishing desired limit values further includes the steps of:

establishing limit values indicative of a first deviation which occurs with a first predetermined period of time, a second deviation which occurs with a second predetermined period of time greater than said first predetermined period of time, and a slope threshold value.

19. Process according to claim 14, wherein said step of monitoring is performed with respect to a measured variable and an independent variable, said independent variable being compared with a set limit value.

20. Process according to claim 19, wherein each time said set limit value is exceeded by an independent variable, said established desired limit values are updated by weighting new measured values and a prior desired limit value.

* * * * *